US006550240B2

(12) United States Patent
Kolmanovsky et al.

(10) Patent No.: US 6,550,240 B2
(45) Date of Patent: Apr. 22, 2003

(54) LEAN ENGINE CONTROL WITH MULTIPLE CATALYSTS

(75) Inventors: Ilya V Kolmanovsky, Ypsilanti, MI (US); Jing Sun, Bloomfield, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,523

(22) Filed: Sep. 14, 2001

(65) Prior Publication Data

US 2003/0051465 A1 Mar. 20, 2003

(51) Int. Cl.[7] ..... F01N 3/00

(52) U.S. Cl. ..... 60/285; 60/274; 60/276; 123/443

(58) Field of Search ..... 60/274, 276, 277, 60/285, 286; 123/443, 692

(56) References Cited

U.S. PATENT DOCUMENTS 5,570,574 A * 11/1996 Yamashita et al. ..... 60/276
5,749,221 A * 5/1998 Kawahira et al. ..... 60/285
5,778,666 A 7/1998 Cullen et al.
5,778,667 A * 7/1998 Kinugasa et al. ..... 60/274
5,970,707 A 10/1999 Sawada et al.
6,014,859 A * 1/2000 Yoshizaki et al. ..... 60/285
6,119,452 A * 9/2000 Kinugasa et al. ..... 123/443
6,189,316 B1 2/2001 Surnilla et al.
6,205,773 B1 3/2001 Suzuki
6,233,925 B1 5/2001 Hirota et al.

* cited by examiner

*Primary Examiner*—Thomas Denion
*Assistant Examiner*—Tu M. Nguyen
(74) *Attorney, Agent, or Firm*—Allan J. Lippa; John D. Russell

(57) ABSTRACT

A method for controlling an engine having multiple banks with separate catalysts is described. In particular, coordinate lean and rich operation between the banks is utilized. However, termination of rich operation may be different between the banks to prevent breakthrough of rich exhaust gasses due to lack of stored oxidants. In this situation, the bank that terminated rich operation is operated near stoichiometric. This minimizes breakthrough of emissions, while at the same time minimizing a torque imbalance between the cylinder banks. In particular, the torque imbalance can be further minimized by retarding ignition timing on the rich bank while the other operates near stoichiometry.

21 Claims, 4 Drawing Sheets

LEAN ENGINE CONTROL WITH MULTIPLE CATALYSTS

BACKGROUND OF INVENTION

The field of the invention relates to lean burn engine control in internal combustion engines.

lean burn engine systems can have different cylinder groups, each having a close-coupled catalytic converter. These cylinder groups come together in a y-pipe configuration before entering a under-body catalyst. The catalyst can store oxidants (including NOx) when operating lean, and release and reduce the oxidants with incoming reductants when operating rich. In this way, emissions are minimized while operating lean by also periodically operating rich. One such system is described in U.S. Pat. No. 5,970,707. In this system, lean and rich operation of the cylinder groups is generally synchronized during normal operation.

The inventors herein have recognized that while the Y-type configuration has some advantages, there may not be enough freedom to optimize exhaust system tuning. In particular, the underbody catalyst typically places a constraint on the location of the Y-pipe to provide optimal temperature window operation for the underbody catalyst.

On the other hand, the inventors herein have also recognized that having a dual exhaust system where two underbody catalysts are used with a Y-pipe joining them afterwards, provides more flexibility in positioning the Y-pipe joint. Therefore, there is more freedom for optimizing the exhaust system tuning.

Finally, the inventors herein have recognized that maintaining synchronous lean and rich engine operation of the dual catalyst path system may not fully use the catalyst's storage ability. In particular, due to component variation of the underbody catalysts, bank to bank variation of engine exhaust gas properties, and different aging rates of components, the catalysts on the different banks may not behave identically. The potential difference in catalyst conversion and storage/regeneration, if coupled with synchronous operation of the banks between lean and rich air fuel ratios, may therefore lead to degraded performance. For example, one catalyst may finish releasing or reducing stored NOx and oxygen before the other one does. In this case, if the rich operation of the two banks continue, there may be hydrocarbon and carbon monoxide break through from the catalyst that has already completely released stored oxidants. If the rich operation stops, on the other hand, the storage capacity of the other catalyst may not be fully regenerated, thereby leading to degraded performance in subsequent operation. In either case, the fuel economy and emissions may be negatively impacted.

SUMMARY OF INVENTION

Disadvantages of prior approaches are overcome by a method for controlling an engine having a first and second group of cylinders, the first group coupled to a first catalyst and the second group coupled to a second catalyst. The method comprises: concurrently operating the first and second cylinder groups rich of stoichiometry; in response to a first indication that said rich operation of at least one of the first and second catalysts should be ended, operating the group coupled to the at least one catalyst near stoichiometry while continuing operation of the other group rich of stoichiometry; and in response to a second indication that said rich operation of the other catalyst should be ended, ending rich operation of the other group. By operating the cylinder group coupled to the catalyst that has depleted stored oxidants near stoichiometry, HC and CO breakthrough are minimized while at the same time minimizing any torque imbalance between the two cylinder groups, i.e., since one bank is operating rich and the other near stoichiometry (with the same amount of air per cylinder), engine torque is substantially maintained since the additional fuel in the rich cylinder does not burn to make torque. Any slight torque increase in torque can be compensated for by ignition retard on the rich cylinder bank. In this way, the other catalyst can also be depleted of stored oxidants. Therefore, the full potential of both catalysts is achieved without sacrificing emission performance or driveability.

An advantage of the above aspect of the invention is therefore improved emissions and more efficient use of catalysts in separate exhaust streams.

Also note that the indications provided above may be given in a variety of ways such as based on air-fuel ratio sensors coupled downstream of the catalyst, based on estimates using other operating parameters, or various other indications.

Other advantages of the present invention will be readily appreciated by the reader of this specification.

BRIEF DESCRIPTION OF DRAWINGS

The object and advantages of the invention claimed herein will be more readily understood by reading an example of an embodiment in which the invention is used to advantage with reference to the following drawings wherein:

DETAILED DESCRIPTION

Figure 1A:
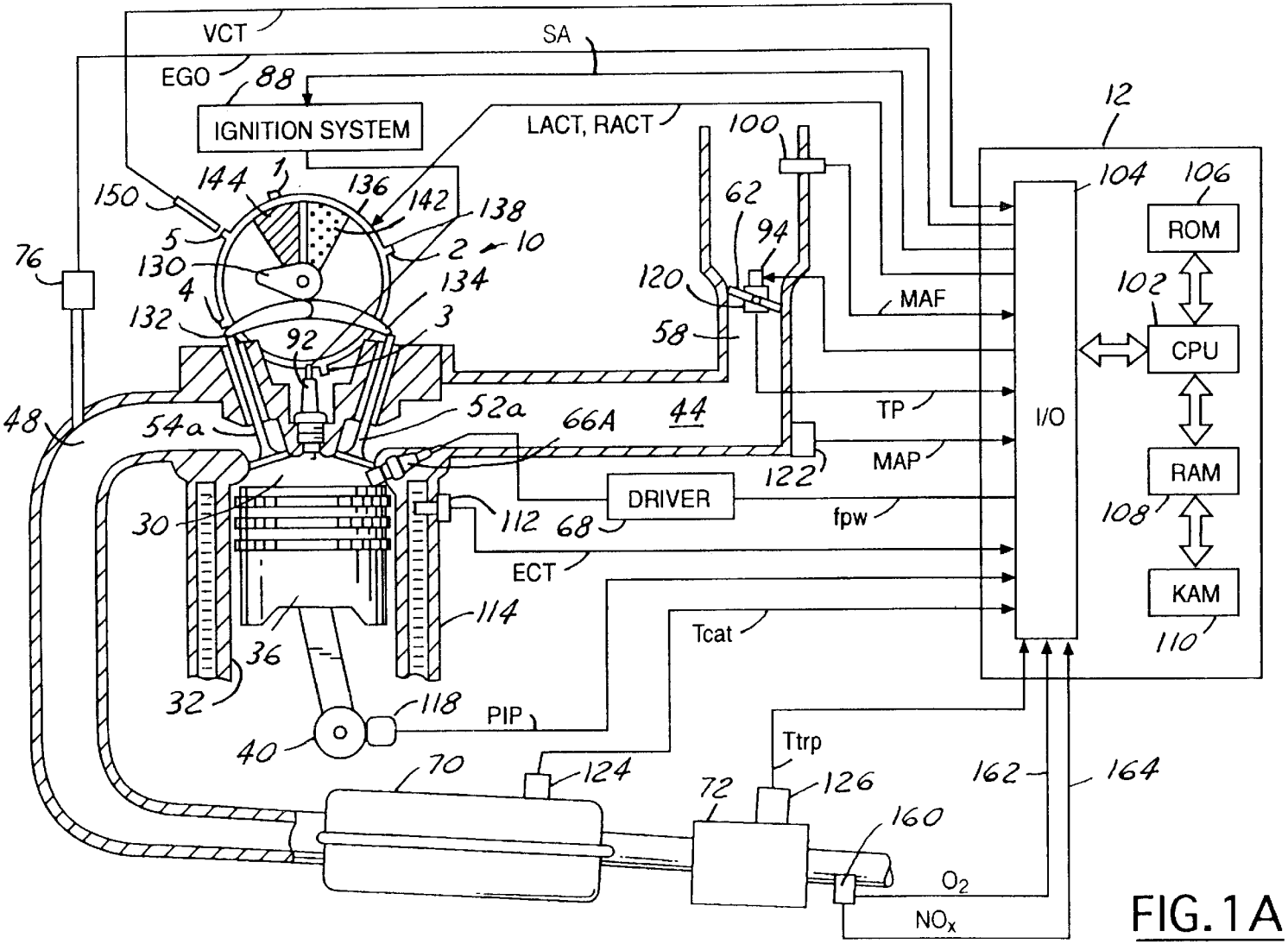
FIGS. 1A and 1B are a block diagrams of an embodiment in which the invention is used to advantage.

Direct injection spark ignited internal combustion engine 10, comprising a plurality of combustion chambers, is controlled by electronic engine controller 12. Combustion chamber 30 of engine 10 is shown in FIG. 1A including combustion chamber walls 32 with piston 36 positioned therein and connected to crankshaft 40. In this particular example, piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering liquid fuel directly therein in proportion to the pulse width of signal fpw received from controller 12 via conventional electronic driver 68. Fuel is delivered to fuel injector 66A by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66A during the engine compression stroke so that fuel is sprayed directly into the bowl of piston 36. Stratified air/fuel layers are thereby formed. The strata closest to the spark plug contains a stoichiometric mixture or a mixture slightly rich of stoichiometry, and subsequent strata contain progressively leaner mixtures. During the homogeneous mode, controller 12 activates fuel injector 66A during the intake stroke so that a substantially homogeneous air/fuel mixture is formed when ignition power is supplied to spark plug 92 by ignition system 88. Controller 12 controls the amount of fuel delivered by fuel injector 66A so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30. An additional split mode of operation wherein additional fuel is injected during the exhaust stroke while operating in the stratified mode is also possible.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and CO and catalyzed during a NOx purge cycle when controller 12 causes engine 10 to operate in either a rich homogeneous mode or a near stoichiometric homogeneous mode.

Controller 12 is shown in FIG. 1A as a conventional microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give and indication of engine load. Further, this sensor, along with engine speed, can provide an estimate of charge (including air) inducted into the cylinder. In a preferred aspect of the present invention, sensor 118, which is also used as an engine speed sensor, produces a predetermined number of equally spaced pulses every revolution of the crankshaft.

In this particular example, temperature Tcat of catalytic converter 70 and temperature Ttrp of NOx trap 72 are inferred from engine operation as disclosed in U.S. Pat. No. 5,414,994, the specification of which is incorporated herein by reference. In an alternate embodiment, temperature Tcat is provided by temperature sensor 124 and temperature Ttrp is provided by temperature sensor 126.

Continuing with FIG. 1A, camshaft 130 of engine 10 is shown communicating with rocker arms 132 and 134 for actuating intake valves 52*a*, 52*b* and exhaust valve 54*a*, 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling as will be described later herein, the relative position of camshaft 130 to crankshaft 40 can be varied by hydraulic pressures in advance chamber 142 and retard chamber 144. By allowing high pressure hydraulic fluid to enter advance chamber 142, the relative relationship between camshaft 130 and crankshaft 40 is advanced. Thus, intake valves 52*a*, 52*b* and exhaust valves 54*a*, 54*b* open and close at a time earlier than normal relative to crankshaft 40. Similarly, by allowing high pressure hydraulic fluid to enter retard chamber 144, the relative relationship between camshaft 130 and crankshaft 40 is retarded. Thus, intake valves 52*a*, 52*b*, and exhaust valves 54*a*, 54*b* open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3, and 4 are preferably used for measurement of cam timing and are equally spaced (for example, in a V-8 dual bank engine, spaced 90 degrees apart from one another) while tooth 5 is preferably used for cylinder identification, as described later herein. In addition, controller 12 sends control signals (LACT,RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time, or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Sensor 160 provides an indication of both oxygen concentration in the exhaust gas as well as NOx concentration.

Signal 162 provides controller a voltage indicative of the O2 concentration while signal 164 provides a voltage indicative of NOx concentration.

Note that FIGS. 1A (and 1B) merely shows one cylinder of a multi-cylinder engine, and that each cylinder has its own set of intake/exhaust valves, fuel injectors, spark plugs, etc.

Figure 1B:
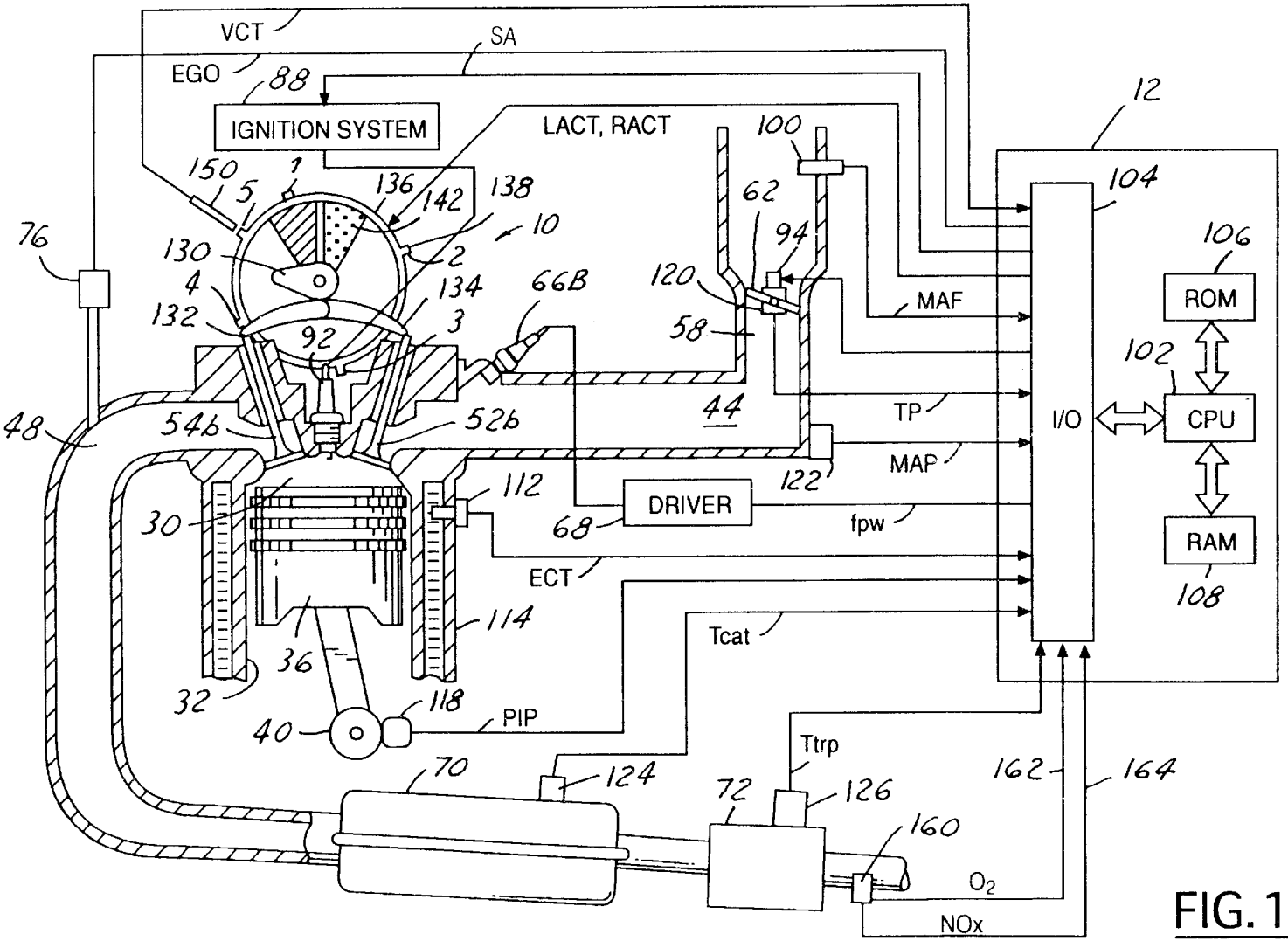

Referring now to FIG. 1B, a port fuel injection configuration is shown where fuel injector 66B is coupled to intake manifold 44, rather than directly cylinder 30.

The engine 10 operates in various modes, including lean operation, rich operation, and "near stoichiometric" operation. "Near stoichiometric" operation refers to oscillatory operation around the stoichiometric air fuel ratio. Typically, this oscillatory operation is governed by feedback from exhaust gas oxygen sensors. In this near stoichiometric operating mode, the engine is operated within one air fuel ratio of the stoichiometric air fuel ratio.

As described above, feedback air-fuel ratio is used for providing the near stoichiometric operation. Further, feedback from exhaust gas oxygen sensors can be used for controlling air-fuel ratio during lean and during rich operation. In particular, a switching type HEGO sensor can be used for stoichiometric air-fuel ratio control by controlling fuel injected (or additional air via throttle or VCT) based on feedback from the HEGO sensor and the desired air-fuel ratio. Further, a UEGO sensor (which provides a substantially linear output versus exhaust air-fuel ratio) can be used for controlling air-fuel ratio during lean, rich, and stoichiometric operation. In this case, fuel injection (or additional air via throttle or VCT) is adjusted based on a desired air-fuel ratio and the air-fuel ratio from the sensor.

Also note that various methods can be used according to the present invention to maintain the desired torque such as, for example, adjusting ignition timing, throttle position, variable cam timing position, and exhaust gas recirculation amount. Further, these variables can be individually adjusted for each cylinder to maintain cylinder balance among all the cylinder groups.

Figure 2:
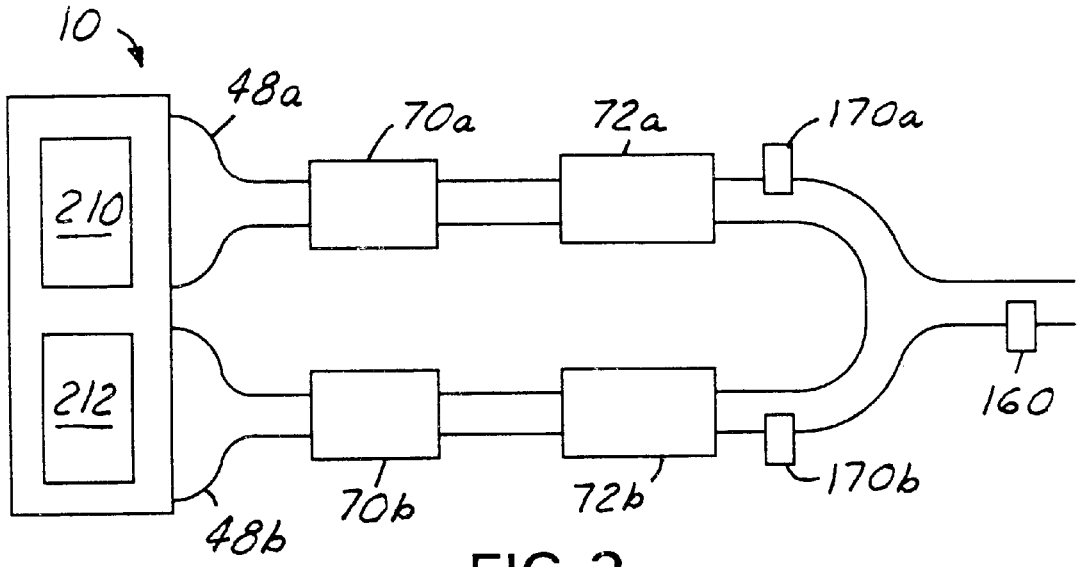
FIG. 2 is a block diagram of an embodiment in which the invention is used to advantage.

Referring now to FIG. 2, engine 10 is shown in a system including the exhaust system. Engine 10 is shown with first and second cylinder groups 210 and 212, respectively. In this particular example, each of groups 210 and 212 has two cylinders. However, the engine groups need not have the same number of cylinders and may include even only one cylinder. First cylinder group 210 is coupled to exhaust manifold 48A, while second cylinder group 212 is coupled to exhaust manifold 48B. Further, exhaust manifold 48A is coupled to first catalytic converter 70A and second catalytic converter 72A. Also, exhaust gas oxygen sensor 170A is coupled downstream of catalyst 72A. Similarly, exhaust manifold 48B is coupled to catalyst 70B and 72B and exhaust gas oxygen sensor 170B. The outlet of catalysts 72A and 72B are coupled to a Y-pipe, which leads to the tailpipe of the vehicle. Sensor 160 is coupled downstream of the Y-pipe. Note that while this is one potential configuration, each cylinder group may be coupled to only a single catalyst. Also, sensor 160 downstream of the Y-pipe may be excluded. Further still, estimates of engine exhaust parameters can be substituted for the measurements provided by sensors 170A and 170B.

Figure 3:
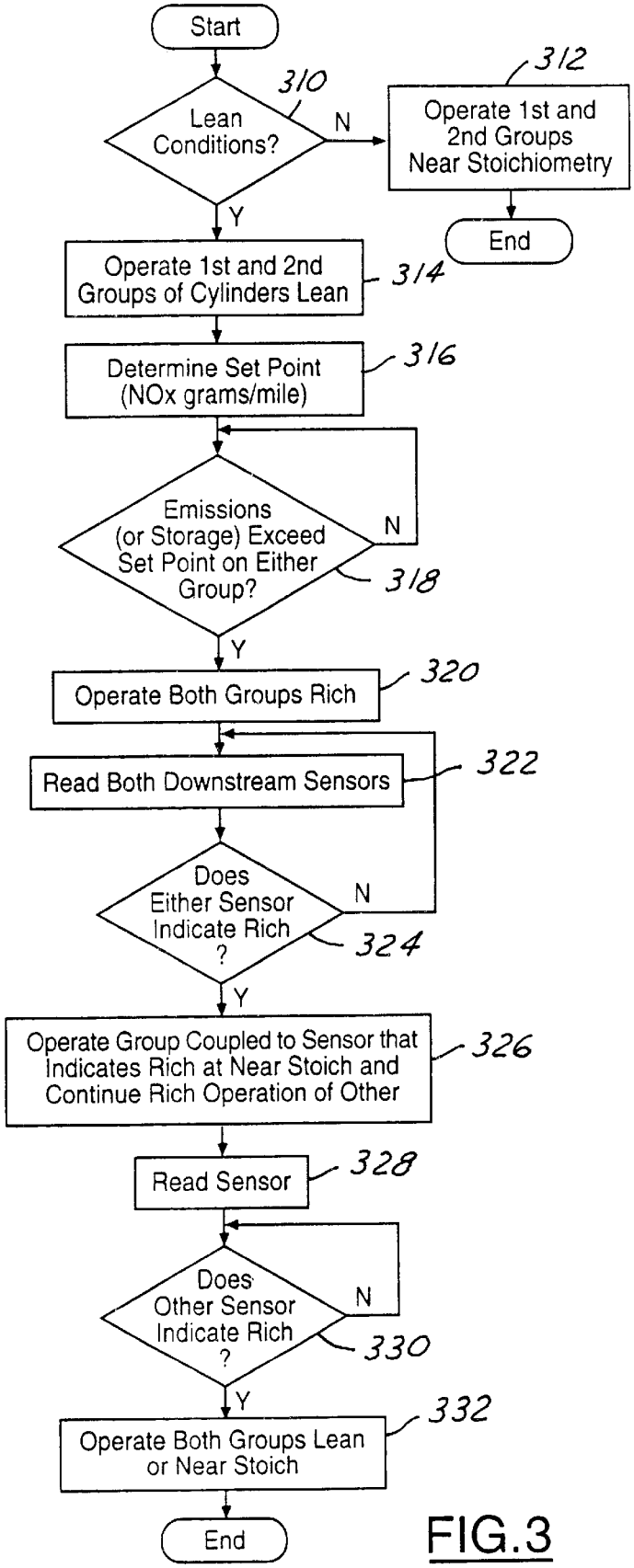
FIG. 3 is high level flowchart which perform a portion of operation of the embodiment shown in FIGS. 1A, 1B, and 2.

Referring now to FIG. 3, a routine for controlling engine operation is described. First, in step 310, the determination is made as to whether operating conditions are such that lean engine operation is desired. In particular, these engine operating conditions may include, for example, vehicle speed, engine torque, engine load, engine speed, engine temperature, catalyst temperature, time since engine start, or various other conditions. When the answer to step 310 is no, the routine continues to step 312 where both the first and second cylinder groups are operated near stoichiometry. For example, fuel injected into the first and second cylinder groups via the fuel injectors is adjusted using a proportional integral controller based on feedback from exhaust gas sensors when 70A, 70B, and further based on an open-loop estimate of air flow in any of the cylinders. This open-loop estimate of air flowing in the cylinders is based on, for example, engine speed and manifold pressure, or mass airflow from the mass airflow sensor.

When the answer to step 310 is yes, the first and second cylinder groups are operated lean of stoichiometry in step 314. In this case, airflow entering the cylinders is adjusted via the electronically controlled throttle 62. Then, in step 316, a set point of NOx grams/mile (tailpipe NOx per distance traveled of the vehicle) is determined based on operating conditions. Note that in an alternative embodiment, a set point amount of NOx stored in the catalysts is determined based on operating conditions. Next, in step 318, a determination is made as to whether the set point has been exceeded on either cylinder group. In other words, a determination is made as to whether either cylinder group is producing higher NOx out of the tailpipe per distance of the vehicle than the set point. In an alternative embodiment, determination is made as to whether the amount of NOx stored in the catalysts of either group is greater than the set point. Further still, a determination as to whether the total NOx exiting the each of the tailpipes per distance of the vehicle exceeds a threshold. When the answer to step 318 is no, the routine repeats. When the answer to step 318 is yes, the routine continues to step 320. In other words, a determination is made on a per cylinder (or per catalyst) basis to determine if either of the separate exhaust paths" catalysts needs to be operated with a rich exhaust air-fuel ratio. Note that there are various other ways to trigger rich operation, such as, for example, based on catalyst deterioration and a learned catalyst rich operating duration.

In Step 320, both cylinder groups are operated with a rich air-fuel ratio. Then, in step 322, sensors 170A and 170B are read. Then, in step 324, a determination is made as to whether either sensor downstream of catalysts 72A and 72B indicates a rich air-fuel ratio. In other words, a determination is made as to whether an indication has been provided that at least one of the first and second catalysts has depleted the stored oxidants (e.g., NOx and $O_2$). Note that there are various alternatives for providing this indication, such as, for example: whether exhaust oxygen concentration is below a threshold value, whether exhaust hydrocarbon or CO concentration is greater than a threshold value, and various others. For example, one alternative, which operates in a different way and provides different results than the previous alternatives, is to determine whether the integrated amount of reductant exiting a catalyst is greater than a threshold.

When an indication is provided in step 324 that either the first or second catalysts has depleted stored oxidants (or an indication that either first or second catalysts should discontinue operation with a rich air-fuel ratio) the routine continues to step 326. Otherwise, the routine returns to step 322.

In step 326, the routine operates the cylinder group coupled to the catalyst whose rich operation should end at a near stoichiometric air-fuel ratio, while continuing rich operation of the other cylinder group. In other words, if, for example, an indication is provided that the first catalyst has depleted stored oxidants (or that the first catalyst should no longer be operated rich) the cylinder group coupled to the first catalyst is operated at the near stoichiometric air-fuel ratio, while continuing operation of the other cylinder group at a rich air fuel ratio to continue the releasing and reducing operation of the second catalyst. In this way, break through of reductants (hydrocarbons and carbon monoxide) is minimized, while maintaining optimal operation of each catalyst. Further, engine torque can be maintained at the desired level (and torque imbalance between the cylinder groups minimized) since the additional fuel injected during the rich operation only minimally may increase engine torque. As described below, if this small torque increase is present, ignition timing retard can be used to further maintain engine torque balance between the two cylinder groups.

Continuing with FIG. 3, in step 328, the sensors downstream of the catalyst are read. Then, in step 330, a determination is made as to whether the other catalyst (i.e., the catalyst that continued rich operation) has depleted oxidant its storage (or whether rich operation of this catalyst should end). As described above, there are various alternative approaches to providing an indication that rich operation of the cylinder group coupled to the other catalysts should be discontinued, and each of this, as well as other alternatives, can again be used here.

When the answer to step 330 is no, the routine continues to step 328 and repeats. When the answer to step 330 is yes, rich operation of the other cylinder group is terminated and the routine proceeds to step 332. At this time, the engine may operate both cylinder groups near stoichiometry, or may return both cylinder groups to lean operation depending on operating conditions as described above in step of 310. After step 332, the routine is complete and is exited.

Thus, according to the present invention, it is possible to provide synchronous lean operation of the cylinder groups and a synchronized transition between lean to rich operation of both cylinder groups, but, asynchronous termination of the rich operation of the two cylinder groups. In particular, whichever cylinder group is coupled to a catalyst that has substantially depleted (or depleted to a certain amount) its oxidant storage, rich operation of the cylinder group coupled to that catalyst should be terminated. Further, that cylinder group is operated near stoichiometry while the rich cylinder operation of the other cylinder group is continued. In this way, optimal performance of the two catalysts is obtained even when the catalysts have different storage release and efficiency characteristics. Once rich operation of both catalysts should be terminated, the engine is then returned to lean operation, or near stoichiometric operation.

As described above, an alternative embodiment uses a set point amount of NOx stored in the catalysts to determine when rich operation should be commenced. In this embodiment, individual catalyst models can be used to determine the NOx storage of each catalyst individually. Also, in step 320, when the engine cylinder groups are both operated rich of stoichiometry, adjustment of the throttle and exhaust gas recirculation valves can be used along with fuel and spark scheduling to maintain engine torque at a desired level. Also, in step 324, as described above, there are various alternatives. Additional alternatives can be used depending on the type of exhaust gas sensor placed downstream of catalysts 72A and 72B. For example, a HEGO sensor can be used as well as a UEGO sensor can be used. Further as described above, estimation models can be used to determine rich operating times which are adjusted based on feedback from sensors 170A and 170B. Also note that if indications are provided simultaneously that rich operation for both cylinder groups should be terminated, then the ending of the rich operation may be synchronized.

Figure 4A:
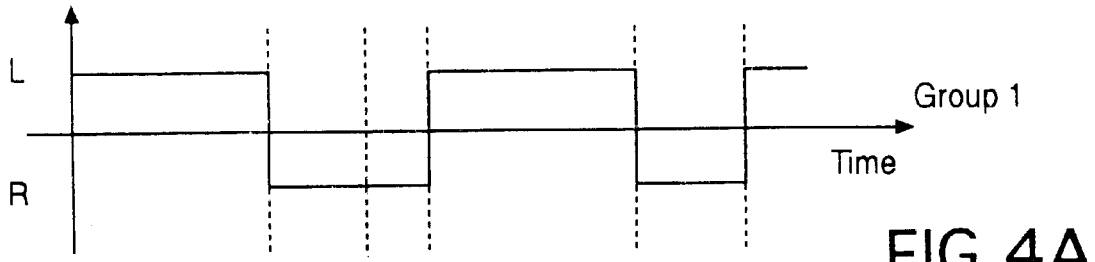
FIGS. 4A and 4B are graphs depicting results using the present invention.
Figure 4B:
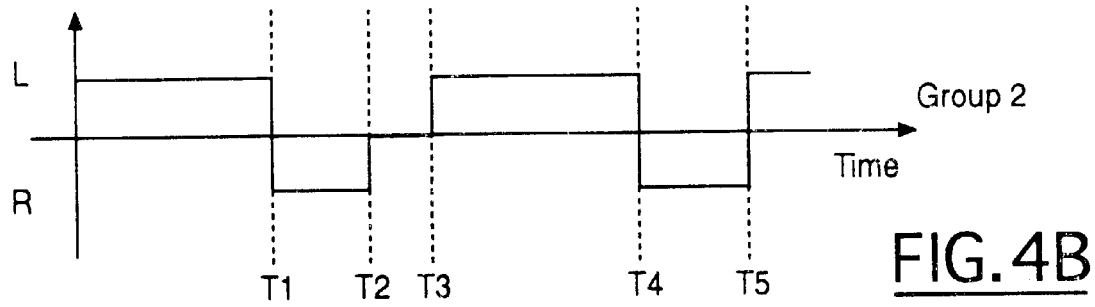

Example operation according to the present invention is as now described with respect to the graphs in FIGS. 4A and 4B. First, the Figures show that the engines are concurrently being operated lean of stoichiometry. Note that the engines do not need to be operated at the same lean air fuel ratio, which is shown in the Figure. Rather, the engines may be operated at different lean air-fuel ratios. Further, the banks do not have to operate a fixed lean air-fuel ratios as shown in the Figure. Rather, the lean air-fuel ratios can vary over time and operating conditions. Then, at time T1, an indication is provided that both cylinder groups should be operated at a rich air-fuel ratio. Again, note that the cylinder groups do not need to be operated at the same rich air-fuel ratio or constant air-fuel ratios. Rather, the rich air-fuel ratios between the groups can vary, as can the rich air-fuel ratio in one of the groups. As with the lean banks, the variation can be based on time or operating conditions.

Continuing with the Figure, the indication provided at time T1 can be based on NOx stored in the catalysts, NOx stored in only one of the catalysts, NOx exiting the tailpipe of the vehicle per distance of the per distance travel, or any other method as described above herein or suggested by this disclosure. In particular, in one example operation according to the present invention, when the amount of estimated NOx stored in one of the catalysts reaches a predetermined limit, both banks are switched to rich operation even though the amount of NOx stored in the other catalyst has not reached a predetermined NOx limit value.

Then, at time T2, an indication is provided that the catalysts coupled to group 2 should terminate the rich operation. At this time, cylinder group 2 is operated near stoichiometry. Then, at time T3, an indication is provided that the catalysts coupled to cylinder group 1 should terminate rich operation. At this time, both cylinder groups are returned to lean operation. Then, at time T4, an indication is provided that both cylinder groups should be operated rich. Then, at time T5, both cylinder groups simultaneously indicate that the rich operation should be terminated. At this time, both cylinder groups are returned to normal lean operation. Note, as described above, near stoichiometric operation may be selected after termination of the rich operation of both cylinder groups.

Note that there are various other alternatives to practicing the present invention, including those described above. Accordingly, it is intended that the present invention be defined only according to the following claims.

What is claimed is:

1. A method for controlling an engine having a first and second group of cylinders, the first group coupled to a first catalyst and the second group coupled to a second catalyst, comprising:

concurrently operating the first and second cylinder groups rich of stoichiometry;

in response to a first indication that said rich operation of at least one of the first and second catalysts should be ended, operating the group coupled to the at least one catalyst near stoichiometry while continuing operation of the other group rich of stoichiometry; and in response to a second indication that said rich operation of the other catalyst should be ended, ending rich operation of the other group.

2. The method recited in claim 1 wherein said first indication is based on a sensor coupled downstream of said at least one catalyst.

3. The method recited in claim 1 wherein said second indication is based on a sensor coupled downstream of the other catalyst.

4. The method recited in claim 1 further comprising:

in response to said second indication, ending near stoichiometric operation of the group coupled to the at least one catalyst.

5. The method recited in claim 4 further comprising:

in response to said first and second indication, returning operation of both cylinders to lean of stoichiometry.

6. The method recited in claim 5 further comprising commencing said concurrent rich operation based on an amount of NOx stored in the catalysts.

7. The method recited in claim 5 further comprising commencing said concurrent rich operation based on an amount of NOx exiting a tailpipe per distance traveled.

8. An article of manufacture, comprising:

a computer storage medium for controlling an engine having a first and second group of cylinders with a first catalyst coupled the first group exclusive of the second group and a second catalyst coupled to the second group exclusive of the first group, said medium comprising:

code for concurrently operating the first and second cylinder groups rich of stoichiometry;

code for providing a first indication that said rich operation of at least one of the first and second catalysts should be ended; and code for operating the group coupled to the at least one catalyst near stoichiometry while continuing operation of the other group rich of stoichiometry in response to said first indication.

9. The article recited in claim 8 further comprising code for providing a second indication that said rich operation of the other catalyst should be ended, and code for ending rich operation of the other group based on said second indication.

10. The article recited in claim 9 further comprising code for ending near stoichiometric operation of the group coupled to the at least one catalyst in response to said second indication.

11. The article recited in claim 10 wherein said code for ending near stoichiometric operation of the group coupled to the at least one catalyst in response to said second indication further comprises code for operating the group coupled to the at least one catalyst at a first lean air-fuel ratio.

12. The article recited in claim 11 wherein said code for ending rich operation of the other group based on said second indication further comprises code for operating the other group at a second lean air-fuel ratio.

13. The article recited in claim 11 wherein said first lean air-fuel ratio is substantially the same as said second lean air-fuel ratio.

14. The article recited in claim 11 further comprising code for retarding ignition timing in the rich cylinder group while the first and second cylinder groups are operated at different air-fuel ratios.

15. A method for controlling an engine having a first and second group of cylinders, the first group coupled to a first catalyst and the second group coupled to a second catalyst, comprising:

concurrently operating the first and second cylinder groups rich of stoichiometry;

in response to a first indication that at least one of the first and second catalysts has depleted stored oxidants, operating the group coupled to the at least one catalyst near stoichiometry while continuing operation of the other group rich of stoichiometry; and in response to a second indication that the other catalyst has depleted stored oxidants, ending rich operation of the other group.

16. The method recited in claim 15 wherein said first indication is based on a sensor coupled downstream of said at least one catalyst.

17. The method recited in claim 15 wherein said second indication is based on a sensor coupled downstream of the other catalyst.

18. The method recited in claim 15 further comprising:

in response to said second indication, ending near stoichiometric operation of the group coupled to the at least one catalyst.

19. The method recited in claim 18 further comprising:

concurrently operating both cylinders lean of stoichiometry.

20. The method recited in claim 19 further comprising commencing said concurrent rich operation based on an amount of NOx stored in the catalysts.

21. The method recited in claim 19 further comprising commencing said concurrent rich operation based on an amount of NOx exiting a tailpipe per distance traveled.

* * * * *